US005693167A

United States Patent [19]

Cahill et al.

[11] Patent Number: 5,693,167

[45] Date of Patent: Dec. 2, 1997

[54] CORRUGATED BOARD MANUFACTURE

[75] Inventors: Michael John Cahill, Coventry; Colin Stutt, Bristol, both of United Kingdom

[73] Assignee: Molins PLC, Blakelands, Great Britain

[21] Appl. No.: 485,416

[22] Filed: Jun. 7, 1995

Related U.S. Application Data

[63] Continuation of Ser. No. 960,448, filed as PCT/GB91/00758 May 14, 1991, abandoned.

[30] Foreign Application Priority Data

May 15, 1990 [GB] United Kingdom ..... 9010814
May 15, 1990 [GB] United Kingdom ..... 9010815

[51] Int. Cl.[6] ..... B31F 1/24

[52] U.S. Cl. ..... 156/205; 156/210; 156/361; 156/470

[58] Field of Search ..... 156/205, 210, 156/470, 471, 472, 473, 583.3, 361

[56] References Cited

U.S. PATENT DOCUMENTS

| | | | |
|---|---|---|---|
| 3,004,880 | 10/1961 | Lord | 156/470 |
| 3,468,734 | 9/1969 | Shields | 156/210 |
| 3,513,054 | 5/1970 | Carrel . | |
| 3,700,518 | 10/1972 | Ohmori . | |
| 3,886,019 | 5/1975 | Wilkinsons | 156/470 |
| 4,419,173 | 12/1983 | Akiyama | 156/470 |
| 4,550,377 | 10/1985 | Craemer | 156/205 |
| 4,755,252 | 7/1988 | Held | 156/583.5 |
| 4,886,563 | 12/1989 | Bennett et al. | 156/205 |
| 5,183,525 | 2/1993 | Thomas | 156/583.5 |

FOREIGN PATENT DOCUMENTS

| | | |
|---|---|---|
| 0 213 957 | 3/1987 | European Pat. Off. . |
| 0 321 247 | 6/1989 | European Pat. Off. . |
| 0 279 609 | 1/1993 | European Pat. Off. . |
| 393 156 | 12/1908 | France . |
| 1494318 | 9/1967 | France . |
| WO 89/09127 | 10/1989 | WIPO . |

*Primary Examiner*—Michele K. Yoder
*Attorney, Agent, or Firm*—Seidel, Gonda, Lavorgna & Monaco, PC

[57] ABSTRACT

Method and apparatus for manufacturing corrugated board comprising two layers of corrugated medium joined together in tip-to-tip registration of the two mediums, without an intermediate liner, and with at least one outer liner. Adhesive is applied to the tips of the two mediums, and the tips are brought together and held in contact with each other while the adhesive sets at least partially during conveyance of the mediums along a linear path.

18 Claims, 4 Drawing Sheets

CORRUGATED BOARD MANUFACTURE

This is a continuation application of Ser. No. 07/960,448, filed as PCT/GB91/00758 May 14, 1991, now abandoned.

This invention is concerned with the manufacture of corrugated board comprising two layers of corrugated medium adhering to one another, with no intermediate liner, and at least one liner adhering to the outer tips of one of the two corrugated mediums. Board of this type is described and illustrated in Australian Patent Applications Nos. 62323/86 and 2271/85, and a machine for manufacturing such board is described in European Patent Application No. 279609, all in the name of Amcor Limited. A further development of the machine is described in our British Patent Application No. PCT/GB 89/01290, to which reference is directed.

According to one aspect of this invention there is provided a process for manufacturing corrugated board comprising two layers of corrugated medium joined together in tip-to-tip registration between the corrugations of the two mediums, without an intermediate liner, and with at least one outer liner, the process comprising feeding webs of corrugating material between respective pairs of corrugating rolls to form the webs into corrugated mediums, applying adhesive to the tips of one of the mediums to permit adhesion with the tips of the other medium, bringing the two mediums together in tip-to-tip registration and from then on conveying them along adjacent linear paths with the assistance; along at least part of the way, of opposed conveyors which hold the mediums together with tip-to-tip registration between the corrugations of the two mediums, and pressing the mediums into contact with one another while the adhesive is caused or allowed to set at least partially during conveyance along the linear paths, at least one outer liner being applied either before or after the corrugated mediums are conveyed along the linear paths in which the tips of their corrugations are brought together.

According to another aspect of the present invention, apparatus adapted for carrying out the above-defined process may comprise means for forming two webs of single-faced corrugated board, means for conveying each single faced web on to a corresponding corrugated register conveyor via a path of variable length, means for controlling and equalising the speeds of the two register conveyors, and means for conveying the single-faced webs from the register conveyors and along adjacent linear paths through a pressure device whereby the single-faced webs are pressed together to cause the tips of the corrugated mediums to adhere to one another while they are conveyed through the pressure device, and including means for applying adhesive to one of the corrugated mediums before the two single-faced webs enter the pressure device.

The means for controlling the speed (and the phase of rotation) of the register rolls with respect with one another, to ensure that the tips of the corrugated materials are accurately aligned, preferably comprises flute count encoders adjacent to the respective register rolls and arranged to control one or both of two independent drive motors for the respective register rolls. Similar flute count encoders are preferably provided adjacent to corrugated rolls of the two single-facer machines whereby the speed of each machine with respect to the corresponding register roll is controlled, any differences being compensated by the means defining a path of variable length between the single-facer machine and the corresponding register roll. The latter means may, for example, comprise a tension roll able to float up and down and adopted to maintain a substantially constant tension in the single faced web.

The pressure device conveys the two single-faced webs along adjacent linear paths. In a preferred arrangement, the pressure device comprises a number of pairs of opposed upper and lower belts, opposed belts being guided so as to be spaced apart by a distance appropriate to press the two corrugated boards together. Between the belts, the boards may be pressed together by air pressure in a chamber above the upper set of belts, the lower belts being arranged to move along a support platen having grooves containing the belts with intermediate lands for supporting the lower, corrugated board. Alternatively, or in addition, downward pressure on the upper board may be applied by flexible bristles.

According to another aspect of this invention, apparatus adapted for carrying out the above-defined process may alternatively comprise means for separately corrugating two webs of corrugating medium, means for applying adhesive to the tips of one corrugated medium, means for bringing the tips of the corrugated medium into alignment and for pressing them together, conveyers for conveying the two corrugated mediums along a linear path while pressing the corrugations together to join them at their tips, and means for subsequently applying and adhering at least one outer liner to the joined corrugated mediums.

In a preferred form of apparatus according to this aspect of the invention, the two corrugated mediums are brought and pressed together by two corrugated rolls (i.e. rolls having corrugated peripheries) of which one has a number of circumferential recesses axially spaced along the roll to leave relatively narrow corrugated portions whereby a high pressure can be applied between those corrugated portions and the corresponding corrugations of the other roll to promote adhesion between the corrugated mediums without requiring a correspondingly large total force; that is to say, the total force is significantly less than would be required to produce the same contact pressure along the entire length of the corrugations between two non-recessed corrugated rolls. The recesses preferably accommodate conveyers formed with outer corrugations aligned with the corrugations of the roll, the conveyers being used to convey the two joined corrugated mediums along the linear path in co-operation with one or more similarly corrugated opposed conveyers.

Examples of apparatus according to this invention will now be described with reference to the accompanying drawings. In these drawings.

Figure 1:
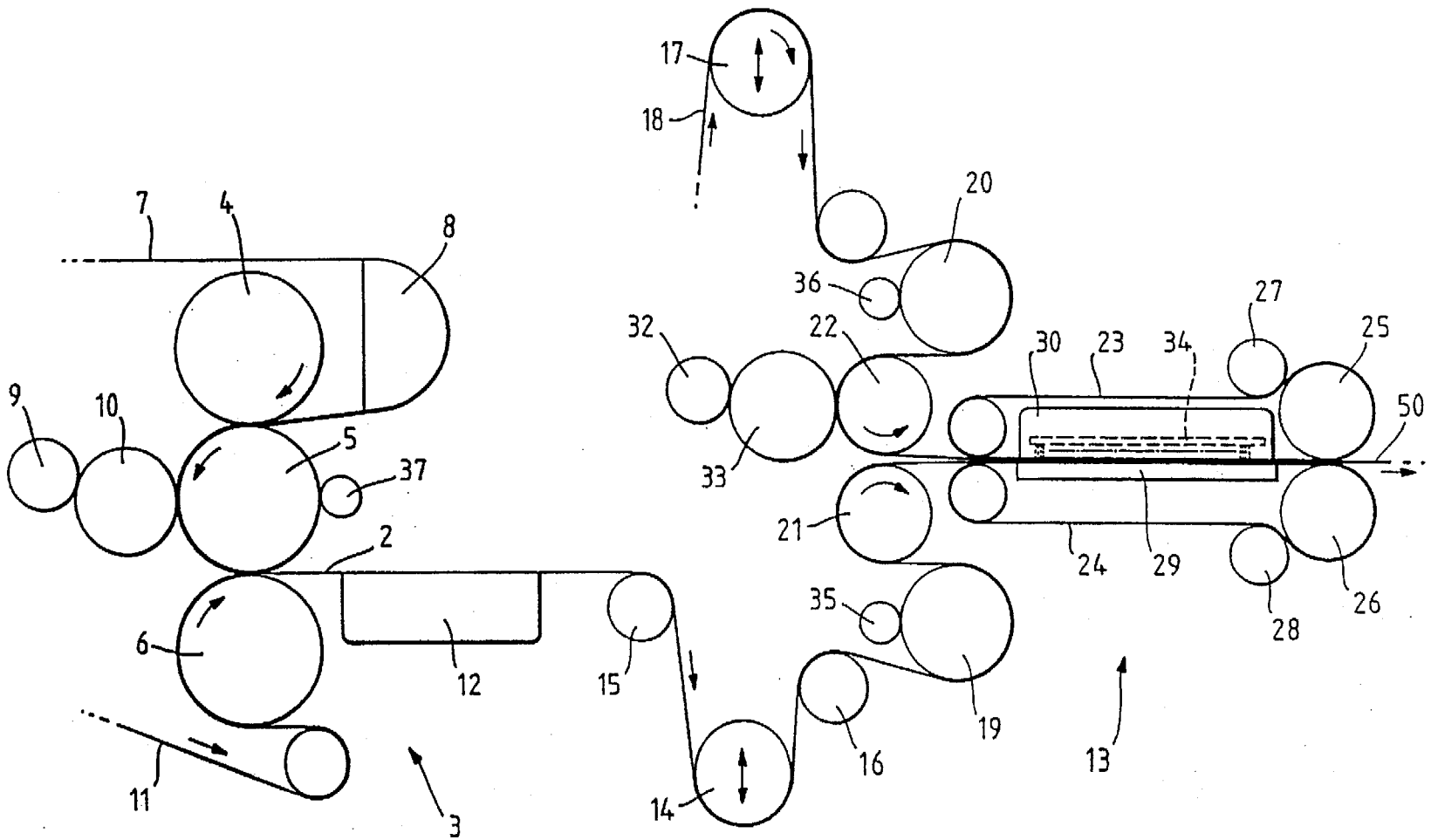
FIG. 1 is a diagrammatic elevation of part of one apparatus according to this invention.

As shown in FIG. 1, one single-faced corrugated web 2 is formed by a single facer machine 3 comprising heated upper and lower corrugating rolls 4 and 5 and a heated press roll 6. A web 7 of corrugating medium passes around a pre-conditioner guide 8 by which it is moistened prior to entry into the nip between the corrugating rolls 4 and 5. A gluing device comprising a metering roll 9 and an applicator roll 10 applies glue to the tips of the corrugated medium to cause adhesion with a liner web 11 conveyed around the press roll 6, thus forming a single-faced corrugated web 2 in which the corrugated medium lies above the liner. An infra-red heater 12 applies more heat to the web as it passes towards a pressure device indicated generally by the reference numeral 13.

A similar single-facer machine (not shown), effectively a mirror image of the single facer machine 3 mounted alcove the machine 3 and slightly further to the left, forms a second single-faced corrugated web 18 of which the corrugated medium lies below the liner.

The single-faced web 2 passes towards the pressure device 13 via a tensioning roll 14 which is movable up and down so as to form a loop of variable lengths between guide rolls 15 and 16. The roll 14 may be of lightweight construction, being in contact with the corrugated material, or may be mounted at its opposite ends on two pivoted levers with counter balance weights so that it applies a limited force to the web 2.

Similarly, an upwardly urged tensioning roll 17 tensions and produces a path of variable length for the second single-faced corrugated web 18.

Corrugated register rolls 19 and 20 associated with the pressure device 13 engage in corrugations of the respective webs 2 and 18 and control the movement of the webs beyond the tensioning devices. The webs pass around the register rolls and around lead rolls 21 and 22 and then converge towards parallel paths extending between sets of upper and lower belts 23 and 24 arranged in upper and lower pairs. These belts are driven by drive rolls 25 and 26 and are tensioned by rolls 27 and 28. The lower boles 24 are supported by a platen 29 having grooves of just sufficient depth to accommodate the belts, the lands between the grooves being at a level such as to support the lower web 2 during its passage through the pressure device.

An air pressure chamber 30 urges the upper single faced corrugated web 18 downwards on to the lower web to cause adhesion between the tips of the corrugated medium, adhesive having been applied to the upper corrugated medium by a device comprising a metering roll 32 and an applicator roll 33. In addition, or as an alternative, pads formed by flexible bristles may be arranged to press down on the upper web in areas lying between the upper belts, one such bristle being shown for example at 34.

The register rolls are driven by separate motors which are electronically timed with respect to one another to ensure that the flute alignment occurs between the two webs. This timing is achieved with the aid of flute count encoders 35 and 36. Similar encoders are mounted adjacent to the exposed portion of the middle roll of each single-facer machine; FIG. 1 shows such an encoder 37 adjacent to the corrugator roll 5 of the lower single-facer 3.

By means of the flute count encoders 35 and 37, for example, a drive motor for the lower single-facer machine is controlled as to its speed so as to maintain an appropriate web speed. This control need not be as accurate as the control between the two register rolls. Means (not shown) are provided for detecting when the tension roll 14 moves upwards beyond a desired upper limit, whereupon the speed of the drive to the single-facer 3 is increased, movement of the tension roll 14 below a desired lower limit being similarly arranged to reduce the speed of the drive to the single-facer 3. A similar control exists between the register roll 20 and the upper single-facer machine.

After leaving the pressure device 13, the double-faced web 50 may pass through a conventional double-racer arrangement (not shown) for applying pressure, pneumatically or by means of weighted conveyors, to opposite faces of the web 50 over a more extended distance while the adhesive fully sets.

The gap between the conveyor bands 23 and 24 of the pressure device may be adjustable so that, for example, conventional double-faced board (with just one corrugated medium) can be manufactured by feeding a simple liner in place of the single-faced web 18. Another permutation made possible by this apparatus is that a third liner may be fed between the two single-faced corrugated webs to form a "double double" board. To facilitate this possibility, tire apparatus may be modified in the region of the pressure device in the manner shown in FIG. 2.

Figure 2:
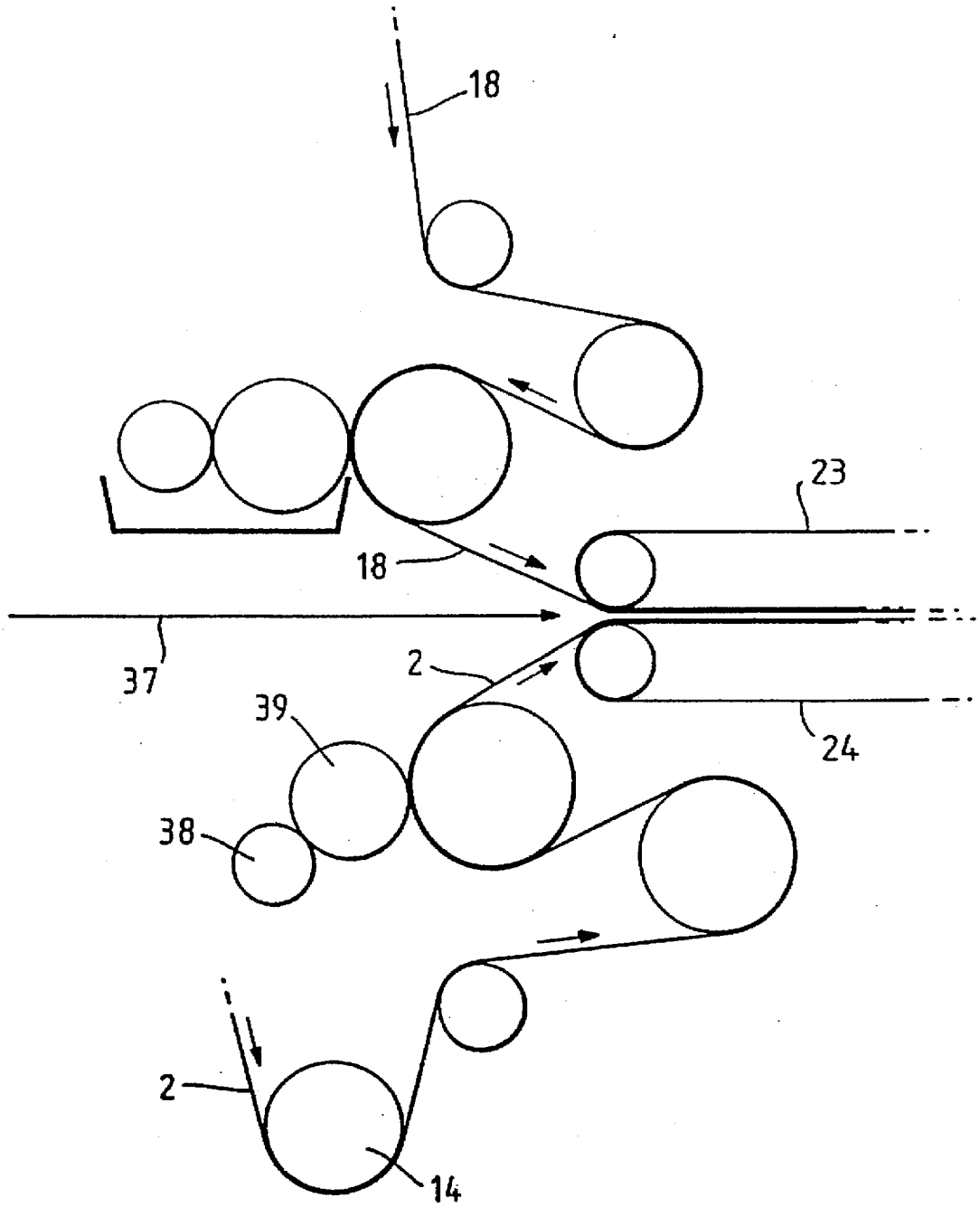
FIG. 2 illustrates diagrammatically a modification in the region of the pressure device.

As shown in FIG. 2, a larger angle of convergence between the two single-faced webs 2 and 18 is provided to facilitate the conveyance between them of a third liner 37. In addition there is a further adhesive applicator comprising rolls 38 and 39 for applying adhesive to the tips of the corrugator medium of the lower web 2.

Figure 3:
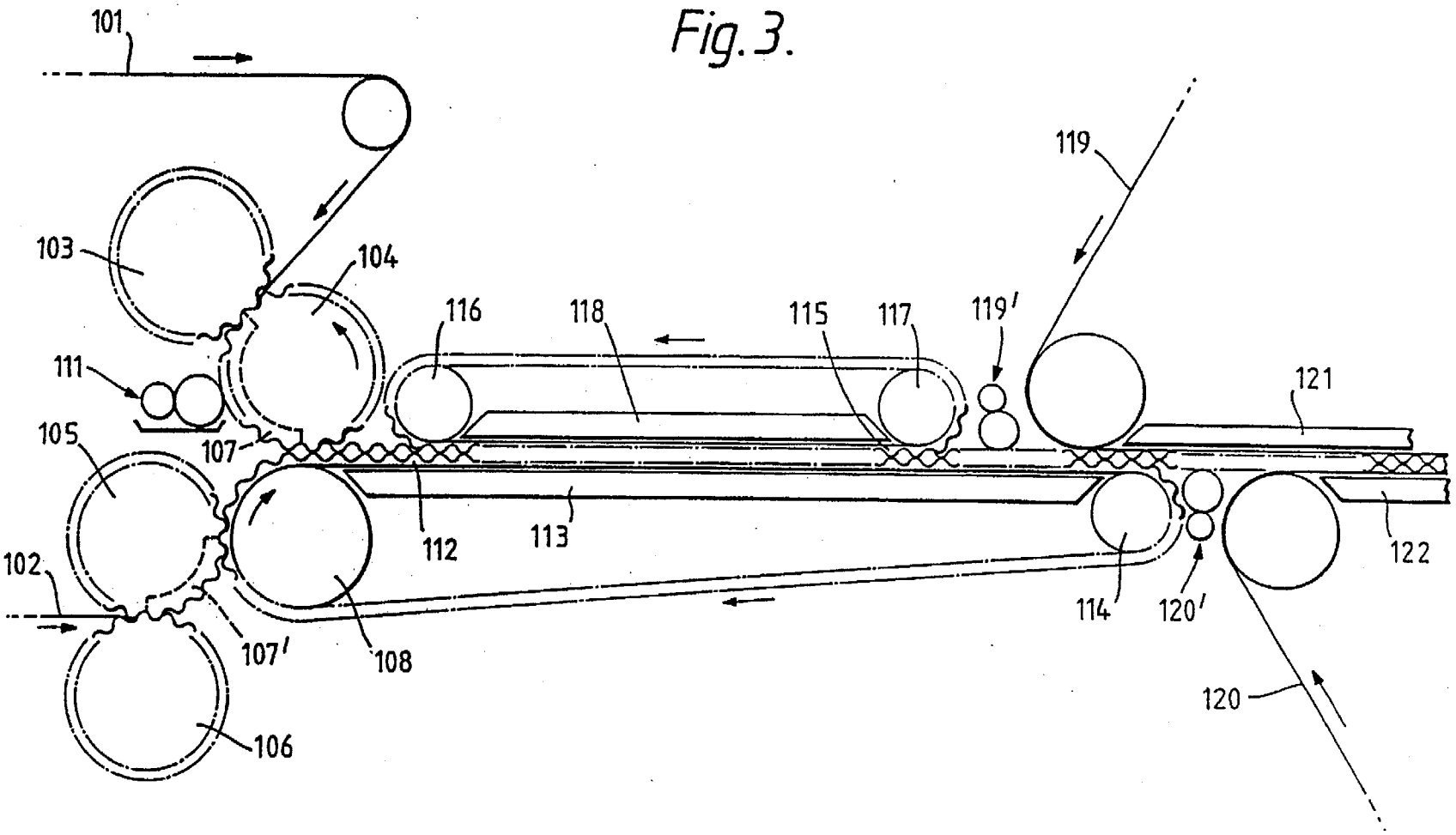
FIG. 3 is a diagrammatic elevation of another apparatus according to this invention.
Figure 4:
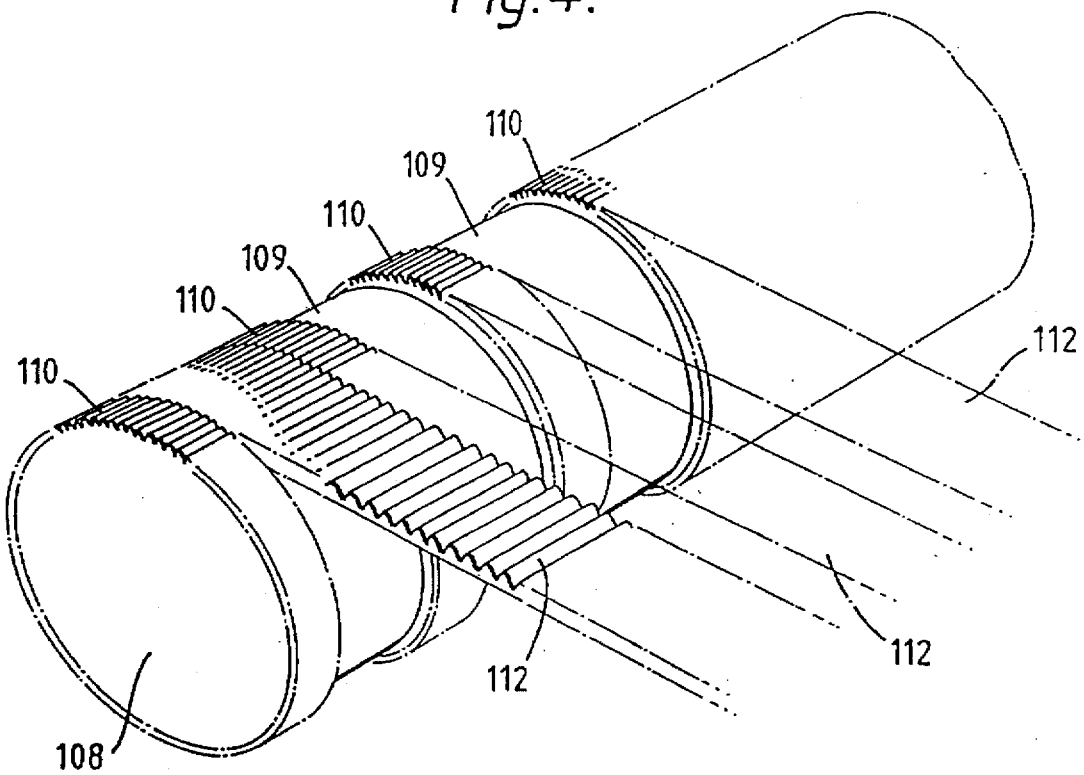
FIG. 4 is a perspective view of one of the rolls in the apparatus shown in FIG. 3.
Figure 5:
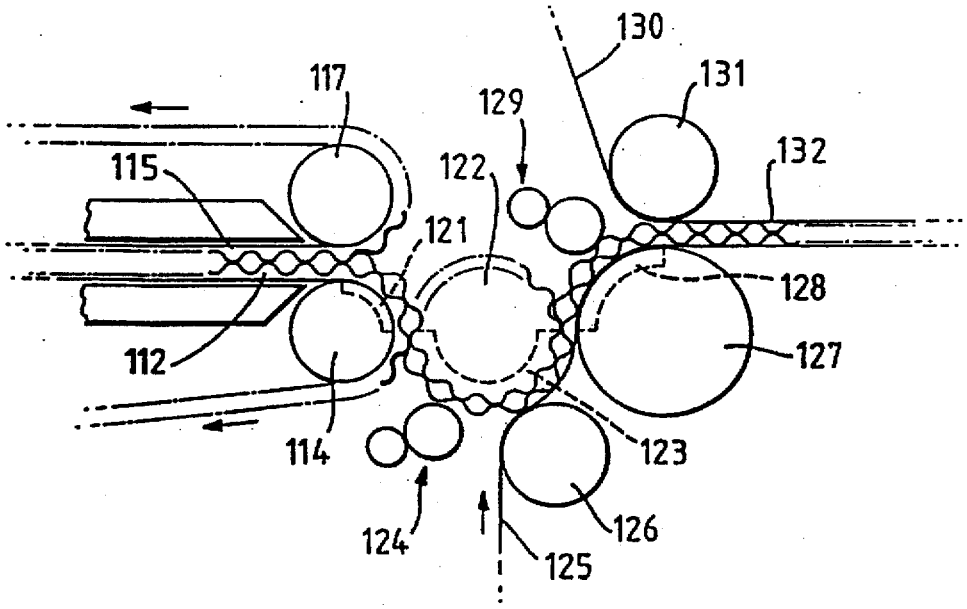
FIG. 5 shows a modification of the right hand end portion of the apparatus shown in FIG. 3.

FIGS. 3 to 5 show a different machine.

FIG. 3 shows webs 101 and 102 of corrugating medium which are corrugated respectively by corrugating rolls 103, 104 and 105, 106. After being corrugated tire webs may be held on the respective rolls 104 and 105 by suction supplied through radial passages in the rolls from suction chambers 107 and 107'.

The corrugated medium 102 is further conveyed by a roll 108 which cooperates with the roll 104 in bringing together the tips of the respective corrugated mediums. As shown in FIG. 4, the roll 108 has a number of circumferential recesses 109 leaving relatively narrow corrugated surfaces 110 for pressing the corrugated mediums 102 against tire medium 101. Adhesive is applied to the tips of the corrugations of the medium 101 by an adhesive applicator unit 111.

The corrugated mediums are conveyed beyond the rolls 108 and 104 initially by conveyor belts 112 which are accommodated in the circumferential recesses in the roll 108 and are formed with external corrugated surfaces which are maintained in alignment with the roll corrugations by engagement with the corrugations of the roll 105. The belts, which may be in the form of moulded belts or may comprise chains, pass over a heater 113 and return around a roller 114.

Pressure contact between the tips of the corrugations of the two mediums is maintained, during movement along the linear path between the rolls 108 and 114, with the aid of a further set of corrugated conveyor belts 115 passing around rolls 116 and 117. The belts 115 are maintained in appropriate timed relation to the belts 112; for example, the belts 115 may have internal timing teeth meshing with teeth on the roll 116, which may in turn be driven from, for example, the roll 108 via gears or a timing belt. A further heater 118 helps to dry the adhesive.

The conveyor belts 112 continue to support the corrugated mediums while adhesive is applied to the tips of the upper medium, by a device 119', prior to the application of a first liner 119. The tips of the lower medium then receive adhesive from a device 120' in preparation for the application of a second liner 120. Further heaters 121 and 122 apply heat to the complete product, and any suitable known means (not shown) may be used for applying pressure until the adhesive is substantially fully set.

FIG. 5 shows an example of another way in which the two outer liners may be applied to the corrugated mediums. The joined corrugated mediums remain on the roller 114, being held by suction from a suction chamber 121, until they are received by a further corrugated roll 122 on which they are held by suction transmitted from a chamber 123. Adhesive is applied to the exposed outer tips of the lower corrugated medium by a device 124, and a liner 125 is then applied to the corrugated mediums, being pressed against them by a heated roll 126. The single-faced corrugated board is then received by a further roll 127 having a smooth circumference, and is held on the roll 127 by suction transmitted from a chamber 128 while adhesive is being applied to the exposed outer tips of the upper corrugated medium by a device 129. A second liner 130 is then applied with the aid of a heated roller 131 so as to form the desired board 132. The board 132 may then pass through any conventional pneumatic or other pressure device for pressing the components of the board together along an extended distance while the adhesive is allowed to fully set.

With reference to FIG. 3, quick adhesion between the corrugated mediums may be achieved by applying a quick-setting adhesive to the corrugated medium 101 along bands corresponding to the corrugated positions 110 of the roll 108. Between those bands a slower drying adhesive may be used.

We claim:

1. A process for manufacturing corrugated board comprising two layers of corrugated medium joined together with tip-to-tip registration of the corrugations of the two mediums, without an intermediate liner, and with at least one outer liner, the process comprising:

feeding one web of corrugating material through a corrugating zone formed at the nip between a first pair of corrugating rolls to form the web into a first corrugated medium, feeding another web of corrugating material through a corrugating zone formed at the nip between a second pair of corrugating rolls to form the second web into a second corrugated medium identical to the first corrugated medium, conveying each of the corrugated mediums away from its corresponding corrugating zone and then bringing the two mediums together at a contact zone with tip-to-tip registration and then immediately conveying them along adjacent linear paths with the assistance, substantially from the start of the linear paths, of opposed linear conveyors which hold the mediums together with tip-to-tip registration between the corrugations of the two mediums, and applying adhesive to the tips of one of the mediums, for permitting adhesion with the tips of the other medium, at a point along the path of said one medium lying between the corrugating zone for that medium and the contact zone at which said one medium is first bought into contact with the other medium, and pressing the mediums into contact with one another while the adhesive is caused or allowed to set at least partially during conveyance along the linear paths, wherein the pressure is exerted by the pair of opposed linear conveyors, the conveyors pressing the corrugated mediums together while they are moving and the adhesive is setting, and controlling and maintaining the tip-to-tip relationship of the corrugated mediums so as to provide a substantially constant board thickness, applying at least one outer liner either before or after the corrugated mediums are conveyed along the linear paths in which the tips of their corrugations are brought together.

2. A process according to claim 1 in which two outer liners are joined to the respective corrugated mediums before the mediums are brought together to be joined to one another.

3. A process according to claim 1 in which two outer liners are joined to the respective corrugated mediums after the corrugated mediums have been joined to one another.

4. Apparatus for manufacturing corrugated board, comprising means including two pairs of corrugating rolls for separately but identically corrugating two mediums and for joining a liner to each corrugated medium, means for conveying each single faced web onto a corresponding corrugated register roll conveyor via a path of variable length, means for controlling and equalizing the speeds of the two register roll conveyors and thereby the timing of the flute tips of the corrugated mediums, and linear conveying means for conveying the single-faced webs, after they have left the register roll conveyors and along adjacent linear paths through a pressure device whereby the single-faced webs are pressed together to cause the tips of the corrugated mediums to adhere to one another while they are conveyed through the pressure device, including means for applying adhesive to one of the corrugated mediums before the two single-faced webs enter the pressure device, and wherein the linear conveying means continuously presses the single-faced webs together while they are moving and the adhesive is setting for controlling and maintaining the tip-to-tip relationship of the corrugated mediums so as to provide a substantially constant board thickness.

5. Apparatus according to claim 4 in which the means for conveying the webs through the pressure device comprises a pair or a number of pairs of opposed belts.

6. Apparatus according to claim 5 in which the opposed belts are arranged to move along a positive air pressure chamber adjacent to the belt bearing on one of the liners.

7. Apparatus according to claim 6 in which a number of parallel belts bearing on the other liner are, while doing so, arranged to move through grooves in a support plate which supports the adjacent liner in areas lying between the belts.

8. Apparatus according to claim 4 in which the means for equalizing the speeds of the two register roll conveyors comprises flute count encoders adjacent to the respective register roll conveyors.

9. Apparatus according to claim 5 in which the opposed conveyors are arranged to move along a positive pressure chamber adjacent to the conveyor bearing on one of the liners.

10. Apparatus for manufacturing corrugated board, comprising means for forming two webs of single-faced corrugated board, means for conveying each single-faced web onto a corresponding fluted register roll conveyor via a path of variable length in respect of at least one of the webs, means for controlling and equalizing the speeds of the two register roll conveyors, and means for conveying the single-faced webs from the register roll conveyors and along adjacent linear paths through a pressure device whereby the single-faced webs are pressed together to cause the tips of the corrugated mediums to adhere to one another while they are conveyed through the pressure device, and including means for applying adhesive to one of the corrugated mediums before the two single-faced webs enter the pressure device, the means for conveying the webs through the pressure device comprising a pair or a number of pairs of opposed belts, at least one of the single-faced webs being arranged to move from its single-facer machine to its corresponding register roll conveyor along a path of variable length including a tensioning roll, and the speed of said at least one of the single-facer machines being controlled in response to the position of the corresponding tensioning roll.

11. Apparatus for manufacturing corrugated board, comprising means for forming two webs of single-faced corrugated board, means for conveying each single-faced web onto a corresponding fluted register roll conveyor via a path of variable length in respect of at least one of the webs, means for controlling and equalizing the speeds of the two register roll conveyors, and means including opposed conveyor belts for conveying the single-faced webs from the register roll conveyors and along adjacent linear paths through a pressure device whereby the single-faced webs are pressed together to cause the tips of the corrugated mediums to adhere to one another while they are conveyed through the pressure device, and including means for applying adhesive to one of the corrugated mediums before the two single-faced webs enter the pressure device, the opposed conveyor belts being arranged to move along a pressure chamber adjacent to the conveyor belt bearing on one of the liners, and at least one of the single-faced webs being arranged to move from its single-facer machine to its corresponding register roll conveyor along a path of variable length including a tensioning roll, and the speed of said at least one of the single-facer machines being controlled in response to the position of the corresponding tensioning roll.

12. Apparatus for manufacturing corrugated board, comprising means for forming two webs of single-faced corrugated board, means for conveying each single-faced web onto a corresponding fluted register roll conveyor via a path of variable length in respect of at least one of the webs, means for controlling and equalizing the speeds of the two register roll conveyors, and means including opposed belt conveyors for conveying the single-faced webs from the register roll conveyors and along adjacent linear paths through a pressure device whereby the single-faced webs are pressed together to cause the tips of the corrugated mediums to adhere to one another while they are conveyed through the pressure device, and including means for applying adhesive to one of the corrugated mediums before the two single-faced webs enter the pressure device, the opposed belt conveyors being arranged to move along a pressure chamber adjacent to the conveyor bearing on one of the liners, and including a number of parallel belts bearing on the other liner and being arranged to move through grooves in a support plate which supports the said other liner in areas lying between the belts, at least one of the single-faced webs being arranged to move from its single-facer machine to its corresponding register conveyor along a path of variable length including a tensioning roll, and the speed of said at least one of the single-facer machines being controlled in response to the position of the corresponding tensioning roll.

13. Apparatus according to claim 5 in which the means for equalizing the speeds of the two register roll conveyors comprises flute count encoders adjacent to the respective register roll conveyors.

14. Apparatus according to claim 6 in which the means for equalizing the speeds of the two register roll conveyors comprises flute count encoders adjacent to the respective register roll conveyors.

15. Apparatus according to claim 7 in which the means for equalizing the speeds of the two register roll conveyors comprises flute count encoders adjacent to the respective register roll conveyors.

16. Apparatus according to claim 11 in which the means for equalizing the speeds of the two register roll conveyors comprises flute count encoders adjacent to the respective register roll conveyors.

17. A process for manufacturing corrugated board comprising two layers of corrugated medium joined together with tip-to-tip registration of the corrugations of the two mediums, without an intermediate liner and with at least one outer liner, the process comprising feeding one web of corrugating material through a corrugating zone formed at the nip between a first pair of peripherally fluted corrugating rolls to form the web into a first corrugated medium; feeding another web of corrugating medium through a second corrugating zone formed at the nip between a second pair of peripherally fluted corrugating rolls to form the web into a second corrugated medium identical to the first corrugated medium; conveying each of the corrugated mediums away from its corrugating zone and then bringing the two mediums together in tip-to-tip registration at a contact zone and and then immediately conveying them along adjacent linear paths; applying adhesive to the tips of one of the mediums to permit adhesion with the tips before the one medium reaches the contact zone at which it first comes into contact with the other medium; pressing the mediums into contact with one another while the adhesive is caused or allowed to set at least partially during conveyance along the linear paths; and applying at least one outer liner either before or after the corrugated mediums are conveyed along the linear paths in which the tips of their corrugations are joined together.

18. Apparatus for manufacturing corrugated board, comprising means for forming two webs of single-faced corrugated board, means for conveying each single-faced web onto a corresponding fluted register roll conveyor via a path of variable length in respect of at least one of the webs, means for controlling and equalizing the speeds of the two register roll conveyors, and means for conveying the single-faced webs from the register roll conveyors and along adjacent linear paths through a pressure device whereby the single-faced webs are pressed together to cause the tips of the corrugated mediums to adhere to one another while they are conveyed through the pressure device, and including means for applying adhesive to one of the corrugated mediums before the two single-faced webs enter the pressure device, at least one of the single-faced webs being arranged to move from its single-facer machine to its corresponding register roll conveyor along a path of variable length including a tensioning roll, and the speed of said at least one of the single-facer machines being controlled in response to the position of the corresponding tensioning roll.

* * * * *